US010125734B2

(12) United States Patent
Paulus et al.

(10) Patent No.: US 10,125,734 B2
(45) Date of Patent: Nov. 13, 2018

(54) METHOD FOR NITRIDING A COMPONENT OF A FUEL INJECTION SYSTEM

(71) Applicant: Robert Bosch GmbH, Stuttgart (DE)

(72) Inventors: Christian Paulus, Saarwellingen (DE); Heinrich Werger, Kuchl (AT)

(73) Assignee: Robert Bosch GmbH, Stuttgart (DE)

( * ) Notice: Subject to any disclaimer, the term of this patent is extended or adjusted under 35 U.S.C. 154(b) by 192 days.

(21) Appl. No.: 15/325,426

(22) PCT Filed: May 5, 2015

(86) PCT No.: PCT/EP2015/059781

§ 371 (c)(1),
(2) Date: Jan. 10, 2017

(87) PCT Pub. No.: WO2016/005073

PCT Pub. Date: Jan. 14, 2016

(65) Prior Publication Data

US 2017/0138326 A1 May 18, 2017

(30) Foreign Application Priority Data

Jul. 11, 2014 (DE) ..... 10 2014 213 510

(51) Int. Cl.
*C23C 8/26* (2006.01)
*F02M 61/16* (2006.01)
(Continued)

(52) U.S. Cl.
CPC ..... *F02M 61/168* (2013.01); *C23C 8/02* (2013.01); *C23C 8/26* (2013.01); *C23C 8/34* (2013.01);
(Continued)

(58) Field of Classification Search
CPC ..... C23C 8/02; C23C 8/26; C23C 8/32
See application file for complete search history.

(56) References Cited

U.S. PATENT DOCUMENTS

2004/0055670 A1 3/2004 Lippmann et al.
2010/0025500 A1* 2/2010 Pollard ..... C23C 8/02 239/584

FOREIGN PATENT DOCUMENTS

DE 3042469 5/1981
DE 69515588 9/2000
(Continued)

OTHER PUBLICATIONS

International Search Report for Application No. PCT/EP2015/059781 dated Aug. 5, 2015 (English Translation, 3 pages).
(Continued)

*Primary Examiner* — Jessee R Roe
(74) *Attorney, Agent, or Firm* — Michael Best & Friedrich LLP

(57) ABSTRACT

The invention relates to a method for nitriding a component of a fuel injection system, said component being loaded under high pressure and being composed of an alloyed steel. The method comprises the following steps: —activating the component in inorganic acid, —pre-oxidizing the component in oxygen-containing atmosphere between 380° C. and 420° C., —nitriding the component between 520° C. and 570° C. at a high first nitriding potential $K_{N,1}$ in the ε nitride range, —nitriding the component between 520° C. and 570° C. at a lower second nitriding potential $K_{N,2}$ in the γ' nitride range.

13 Claims, 3 Drawing Sheets

(51) Int. Cl.

| | |
|---|---|
| ***C23C 8/02*** | (2006.01) |
| ***C23C 8/34*** | (2006.01) |
| ***F02M 61/10*** | (2006.01) |

(52) U.S. Cl.

CPC ..... *F02M 61/10* (2013.01); *F02M 61/166* (2013.01); *F02M 2200/9038* (2013.01)

(56) References Cited

FOREIGN PATENT DOCUMENTS

| | | | |
|---|---|---|---|
| DE | 10056842 | | 6/2002 |
| DE | 10256590 | | 6/2004 |
| DE | 102009035288 | | 2/2010 |
| EP | 1318529 | | 6/2003 |
| EP | 2146087 | A2 | 1/2010 |
| JP | H0978223 | A | 3/1997 |
| JP | 2002241922 | A | 8/2002 |
| JP | 2013249524 | A | 12/2013 |
| WO | 0142528 | | 6/2001 |
| WO | 2006018348 | | 2/2006 |

OTHER PUBLICATIONS

Stiles, M., et al., "Beschleunigung des Gasnitrierprozesses durch eine Vorbehandlung in der reaktiven Gasphase", HTM Harterei Technische Mitteilungen: Zeitschrift for Werkstoffe, Warmebehandlung Und Fertigung, vol. 53, No. 4, Jul. 1998, pp. 211-221.

Jong, J. et al., "Auswirkung von Reaktionsschichten an Stahloberflachen beim kurzzeitigen Gasnitrieren", HTM. Härterei-technische Mitteilungen: Zeitschrift Fur Werkstoffe, Warmebehandlung Und Fertigung, vol. 52, No. 6, Nov. 1997, pp. 356-364.

Mittermeijer, E.J. "Fundamentals of Nitriding and Nitrocarburizing", ASM Handbook: Steel Heat Treating Fundamentals and Processes, vol. 4A, Nov. 30, 2013, pp. 619-646.

* cited by examiner

METHOD FOR NITRIDING A COMPONENT OF A FUEL INJECTION SYSTEM

BACKGROUND OF THE INVENTION

The invention relates to a method for nitriding a component of a fuel injection system, said component being subject to high pressure and being composed of an alloyed steel.

German Laid-Open Application DE 102 56 590 A1 discloses that an injection nozzle of a fuel injection system is very robust if the injection nozzle is in a nitrided state. In this case, corrosion resistance and wear resistance, in particular, are enhanced. However, no details are given of the nitriding method per se in this publication.

WO publication WO 2001/042528 A1 has furthermore disclosed a method for nitriding an injection nozzle. The known nitriding method comprises a nitrocarburizing process in a salt bath in a first step, followed, in a second step, by a gas nitriding process at a temperature between 520° C. and 580° C. with a low nitriding index or low nitriding potential (in a range between 0.08 and 0.5), i.e. in the "a range" of the Lehrer diagram.

The stresses on the components of a fuel injection system carrying fuel under very high pressure—especially in the region of restrictions—can lead to very high cavitation stresses on these components. Even in the case of the components treated by the nitriding methods described above, this can lead to relatively severe cavitation damage.

SUMMARY OF THE INVENTION

In contrast, the nitriding method according to the invention minimizes the cavitation damage caused by the high pressures by further increasing ductility (toughness) below the surface of the material of the components by means of the nitriding method. In addition, the nitriding has a positive effect on pulsating fatigue strength. The life and endurance of the components is thereby increased.

For this purpose, the method for nitriding a component of a fuel injection system, said component being subject to high pressure and being composed of an alloyed steel, has the following method steps:

- activating the component in inorganic acid,
- pre-oxidizing the component in an oxygen-containing atmosphere between 380° C. and 420° C.,
- nitriding the component between 520° C. and 570° C. at a high first nitriding potential $K_{N,1}$ in the ε nitride range,
- nitriding the component between 520° C. and 570° C. at a low second nitriding potential $K_{N,2}$ in the γ' nitride range.

By means of activation, the resistance of the component to penetration by nitrogen diffusion is reduced. This step therefore increases the capacity of the component for nitriding. The subsequent pre-oxidization process leads to the component having a higher corrosion resistance during operation.

The actual nitriding is divided into two steps, in which gas containing ammonia is preferably used:

- a first nitriding step with a first nitriding potential $K_{N,1}$ in the ε nitride range is used for nitrogen absorption by the component and hence to increase the hardness of the component, both in the "white layer" at the surface of the component and in the diffusion layer below it.
- a second nitriding step with a second nitriding potential $K_{N,2}$ in the γ' nitride range has the effect that the white layer does not become too thick. Although the white layer is very hard, it is, at the same time, very brittle and hence also very susceptible to cavitation stresses.

The nitriding method according to the invention not only reduces the thickness of the brittle white layer but, in particular, reduces the nitride inclusions along the grain boundaries in the diffusion layer as compared with the known nitriding methods. As a result, the grain boundaries are less susceptible to fracture, increasing toughness and hence robustness with respect to cavitation and enhancing the pulsating fatigue strength of the component.

It is advantageous if the first nitriding potential $K_{N,1}$ is between 1 and 10, preferably between 2 and 8. The first nitriding potential $K_{N,1}$ is therefore relatively high. As a result, the range in the Lehrer diagram at temperatures between 520° C. and 570° C. is substantially the c nitride range, which ensures high nitrogen absorption by the activated component around which nitriding gas flows.

It is furthermore advantageous if the second nitriding potential $K_{N,2}$ is between 0.2 and 0.4. The second nitriding potential $K_{N,2}$ is therefore relatively low. As a result, deep diffusion of a high nitrogen content into the component is prevented. The nitrogen content is increased predominantly in the white layer; in the base material, the percentage of nitrogen by mass increases to no more than about 6%. The toughness of the material is thus very largely maintained.

In an advantageous embodiment, a component that has been nitrided by the method according to the invention has a percentage of nitrogen by mass at the surface thereof between 11% and 25%. This ensures a very hard, cavitation-resistant, wear-resistant and corrosion-resistant surface of the component.

In another advantageous embodiment, a component which has been nitrided by the method according to the invention has a percentage of nitrogen by mass of between 3% and 8% at a first depth $t_1$ of 10 μm from the surface of the component. The comparatively large fall in the percentage of nitrogen by mass at a depth of just 10 μm leads to a relatively high toughness of the component, despite the high surface hardness. The transition from the white layer to the diffusion layer is also situated approximately at this depth in the component.

In another advantageous embodiment, a component which has been nitrided by the method according to the invention has a percentage of nitrogen by mass of between 2% and 7% at a second depth $t_2$ of 15 μm from the surface of the component. This leads to a further increase in the toughness of the component in comparison with known nitriding methods.

In another advantageous embodiment, a component which has been nitrided by the method according to the invention has a percentage of nitrogen by mass of between 2% and 6% at a third depth $t_3$ of 20 μm from the surface of the component. This leads to a further increase in the toughness of the component in comparison with known nitriding methods.

From this depth in the component, the percentage of nitrogen changes asymptotically as far as the end of the diffusion zone and then falls relatively abruptly at the end of the diffusion zone to the percentage of nitrogen already contained in the base material. In this case, the diffusion zone usually extends up to about 500 μm into the interior of the component. From the third depth $t_3$ onward, the percentage of nitrogen has fallen to such an extent that there is only a small number of nitride inclusions. Thus, the material has the necessary toughness from this depth in the component.

In an advantageous embodiment, the component is a nozzle body of a fuel injector for injecting fuel into a combustion chamber of an internal combustion engine, wherein the fuel injector has a nozzle needle, which is guided for longitudinal movement in the nozzle body. Precisely because of the high pressure and the high speed of flow of the fuel in the fuel injector and, more specifically, in the nozzle body there, the nozzle body is suitable for a nitriding method according to the invention. There may be very high cavitation stress at the nozzle body injection openings leading into the combustion chamber of the internal combustion engine, for example. Owing to the increased pulsating fatigue strength of the nozzle body due to the nitriding method according to the invention, cavitation damage caused thereby can be minimized or even entirely avoided.

DETAILED DESCRIPTION

Figure 1:
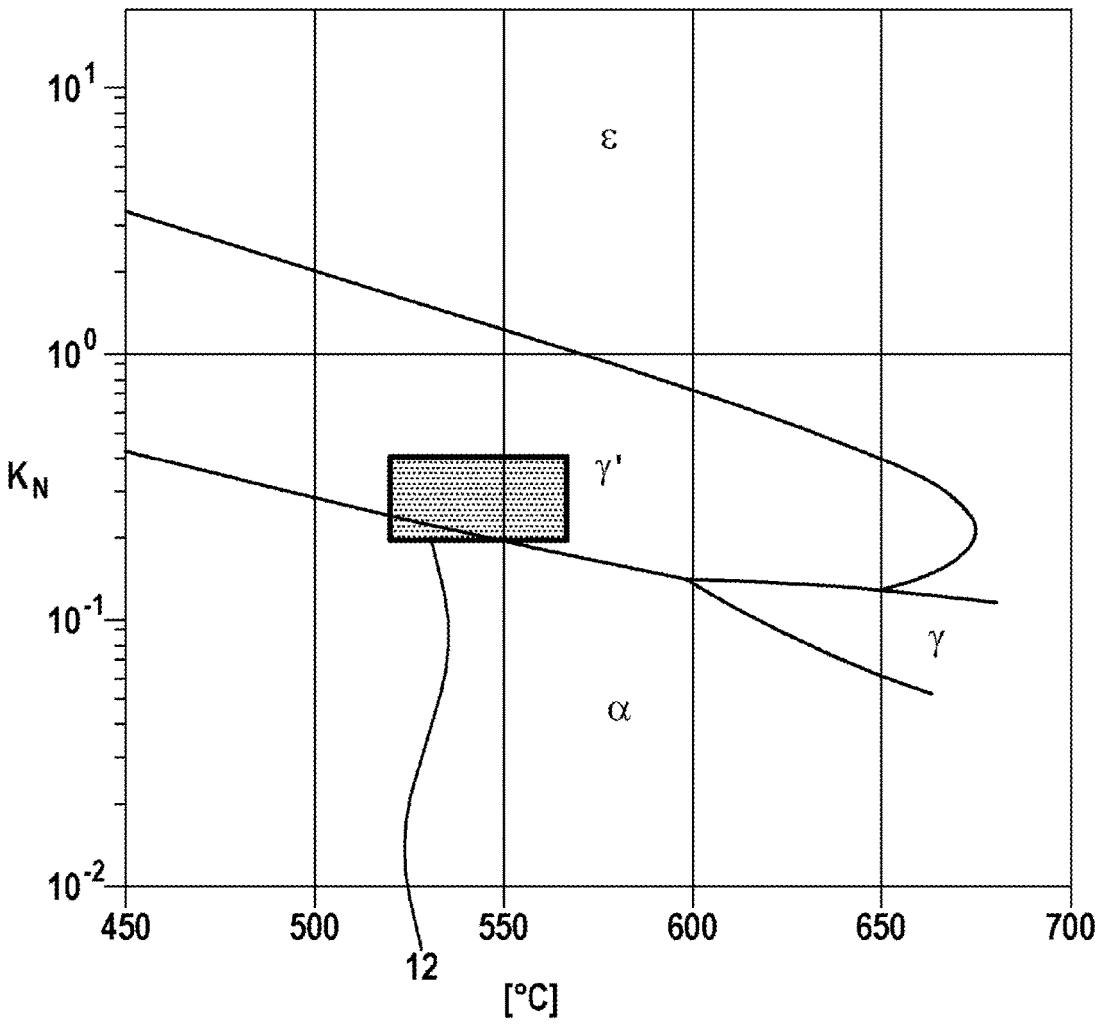
FIG. 1 shows a Lehrer diagram, in which the nitriding potential $K_N$ is plotted against the nitriding temperature T, wherein a range for a method step of the method according to the invention is indicated by a second nitriding potential $K_{N,2}$.

FIG. 1 shows a Lehrer diagram: the various state phases of the iron-nitrogen system of a component are shown as a function of temperature T and nitriding potential $K_N$. The nitriding potential $K_N$ is plotted logarithmically against the nitriding temperature T. The Lehrer diagram does not show the nitriding time but it is generally in a range of between 1 hour and 100 hours.

The nitriding potential $K_N$ is defined as $$K_N = \frac{p(NH_3)}{p(H_2)^{3/2}}$$

Here, $p(NH_3)$ is the partial pressure of the ammonia and $p(H_2)$ is the partial pressure of the hydrogen. The partial pressure is in each case the pressure in an ideal gas mixture, which is associated with an individual gas component. This means that the partial pressure corresponds to the pressure which the individual gas component would exert in the relevant volume if it were present in isolation. The partial pressure is generally used instead of the mass concentration when the diffusion behavior of the dissolved gas is being considered.

The state phases of the iron-nitrogen system are divided into an ε nitride range, a γ nitride range, a γ' nitride range and an a nitride range. ε nitrides have very high percentages of nitrogen by mass and are generally found at the surface of the nitrided component, the "white layer" or the diffusion layer situated below the latter. The γ' nitride range likewise has a high percentage of nitrogen, but the nitrogen atoms are more ordered than in the ε nitride range. The γ' nitride range is likewise found in the white layer and diffusion layer. Both the ε nitride range and the γ' nitride range are relatively hard and brittle. At temperatures which are very high but outside the nitriding method according to the invention, γ nitrides also occur, and these have very high nitrogen concentrations. The α nitride range has a relatively low nitrogen concentration and is relatively tough. α nitride ranges are generally found in the diffusion layer and in the base material.

FIG. 1 shows a hatched region 12, which is substantially in the γ' nitride range, with a temperature T in the range between about 520° C. and 570° C. and with a nitriding potential $K_N$ in a range between about 0.2 and 0.4. In the nitriding method according to the invention, this hatched region designates the method step with the low second nitriding potential $K_{N,2}$.

Figure 2:
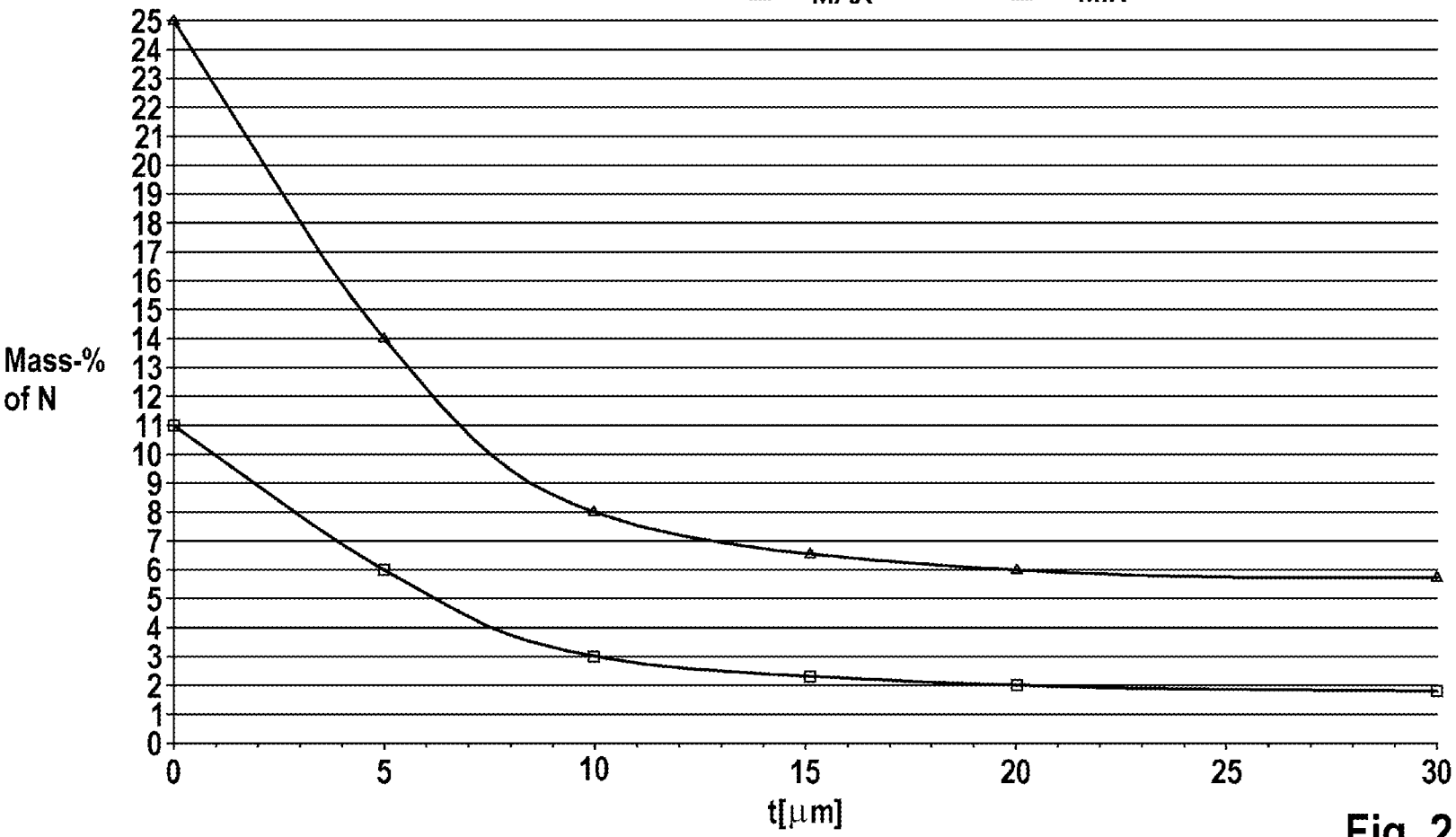
FIG. 2 shows a diagram in which the percentage of nitrogen by mass of a component nitrided by the method according to the invention is shown as a function of depth in the component.

FIG. 2 shows a diagram in which the percentage of nitrogen by mass "% of N by mass" of a component nitrided by the method according to the invention is plotted against the depth in the component "t [μm]". In this case, the depth tin the component is perpendicular to the surface and the percentage of nitrogen by mass is given for a region which is at least 1 mm from the nearest edge or the nearest contour transition. The "MAX" curve represents the maximum and the "MIN" curve represents the minimum percentage of nitrogen by mass in the treated component.

In FIG. 2, it can be seen that the nitrogen-containing white layer of a component treated by the method according to the invention is only about 5 μm to 10 μm thick, after which the diffusion layer begins. The diffusion layer can extend by up to 500 μm into the depth of the component, although this is not shown in FIG. 2 for reasons connected with illustration.

Figure 3:
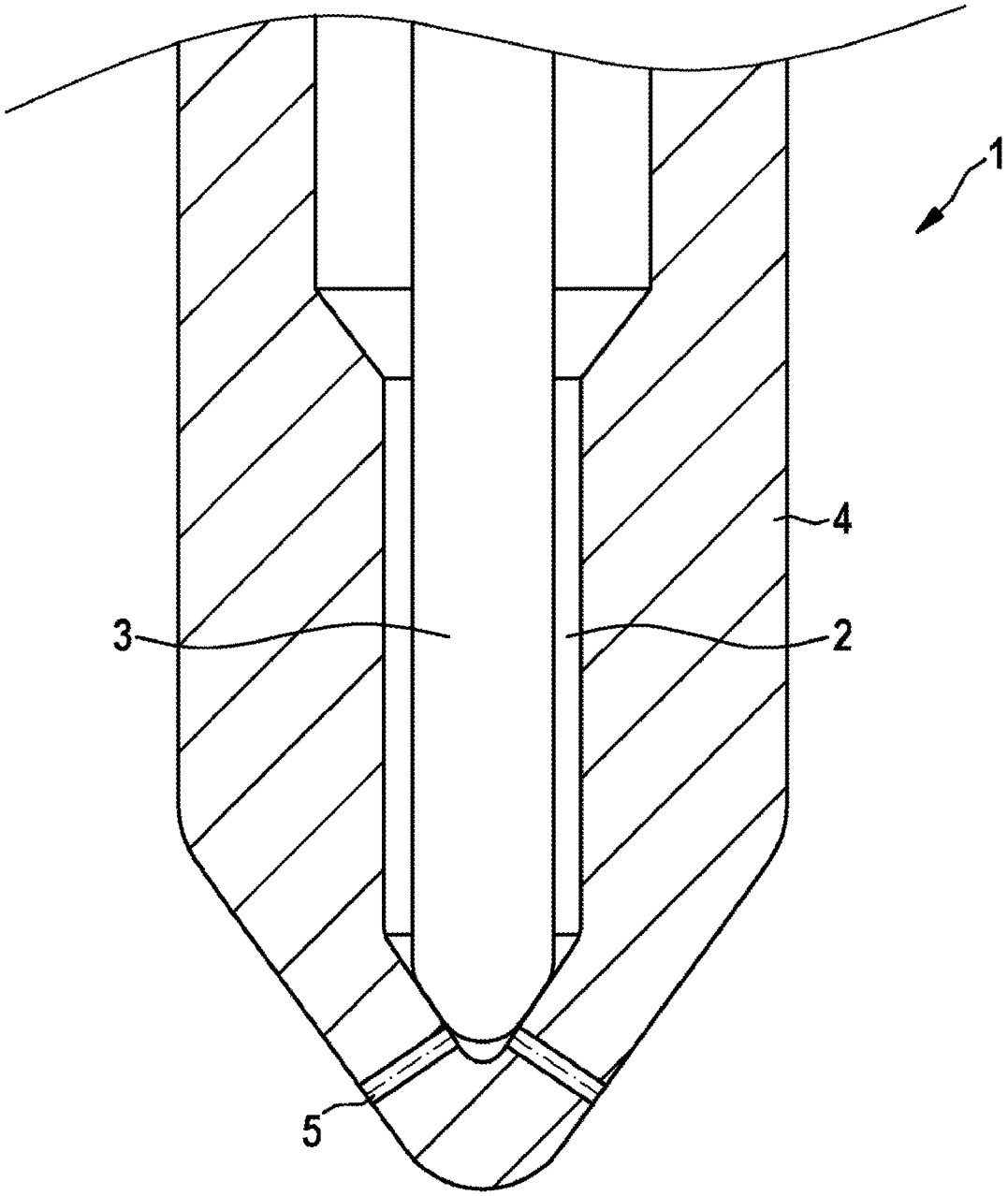
FIG. 3 shows schematically part of a fuel injector, wherein only the significant regions are shown.

FIG. 3 shows schematically part of a fuel injector 1, wherein only the significant regions are shown. The fuel injector 1 has a nozzle body 4, in which a pressure chamber 2 is formed. The pressure chamber 2 is filled with fuel under high pressure and is supplied by a common rail (not shown) or a high-pressure pump (not shown) of a fuel injection system, for example. A nozzle needle 3 is arranged for longitudinal movement in the pressure chamber 2. By its longitudinal movement, the nozzle needle 3 opens and closes injection openings 5 formed in the nozzle body 4 for the injection of fuel into a combustion chamber of an internal combustion engine (not shown). The nozzle body 4 is subject to cavitation risks particularly in the region of the injection openings 5. To increase the cavitation resistance of the nozzle body 4, the nitriding method according to the invention is used.

The method according to the invention for nitriding a fuel injection system component, e.g. the nozzle body 4, subject to high pressure and composed of an alloyed steel, comprises the following method steps:

1) activating the component in inorganic acid.
2) pre-oxidizing the component in an oxygen-containing atmosphere between 380° C. and 420° C.
3) nitriding the component between 520° C. and 570° C. at a high first nitriding potential $K_{N,1}$ in the ε nitride range, preferably where $1 \leq K_{N,1} \leq 10$.
4) nitriding the component between 520° C. and 570° C. at a low second nitriding potential $K_{N,2}$ in the γ' nitride range, preferably where $0.2 \leq K_{N,2} \leq 0.4$.

A percentage of nitrogen by mass as a function of the depth t in the component as shown in FIG. 2 is thereby obtained for the component.

The invention claimed is:

1. A method for nitriding a component of a fuel injection system, said component being subject to high pressure and being composed of an alloyed steel, said method comprising the following method steps:

activating the component in inorganic acid, pre-oxidizing the component in an oxygen-containing atmosphere between 380° C. and 420° C., nitriding the component between 520° C. and 570° C. at a high first nitriding potential $K_{N,1}$ in the ε nitride range, and nitriding the component between 520° C. and 570° C. at a low second nitriding potential $K_{N,2}$ in the γ' nitride range.

2. The method as claimed in claim 1, characterized in that the first nitriding potential $K_{N,1}$ is between 1 and 10.

3. The method as claimed in claim 1, characterized in that the second nitriding potential $K_{N,2}$ is between 0.2 and 0.4.

4. The method as claimed in claim 1, wherein the component is nitrided such that a percentage of nitrogen by mass at a surface of the component is between 11% and 25%.

5. The method as claimed in claim 4, wherein the component is nitrided such that the percentage of nitrogen by mass at a first depth $t_1$ of 10 μm from the surface of the component is between 3% and 8%.

6. The method as claimed in claim 5, wherein the component is nitrided such that the percentage of nitrogen by mass at a second depth $t_2$ of 15 μm from the surface of the component is between 2% and 7%.

7. The method as claimed in claim 6, wherein the component is nitrided such that the percentage of nitrogen by mass at a third depth $t_3$ of 20 μm from the surface of the component is between 2% and 6%.

8. A method of manufacturing a fuel injector (1) for injecting fuel into a combustion chamber of an internal combustion engine, having a nozzle needle (3) which is guided for longitudinal movement in a nozzle body (4), wherein the nozzle body (4) is the component nitrided by the method as claimed in claim 4.

9. A component nitrided by a method in claim 1, characterized in that a percentage of nitrogen by mass at a surface of the component is between 11% and 25%.

10. The component as claimed in claim 9, characterized in that the percentage of nitrogen by mass at a first depth $t_1$ of 10 μm from the surface of the component is between 3% and 8%.

11. The component as claimed in claim 10, characterized in that the percentage of nitrogen by mass at a second depth $t_2$ of 15 μm from the surface of the component is between 2% and 7%.

12. The component as claimed in claim 11, characterized in that the percentage of nitrogen by mass at a third depth $t_3$ of 20 μm from the surface of the component is between 2% and 6%.

13. A fuel injector (1) for injecting fuel into a combustion chamber of an internal combustion engine, having a nozzle needle (3) which is guided for longitudinal movement in a nozzle body (4), characterized in that the nozzle body (4) is a component as claimed in claim 9.

* * * * *